United States Patent [19]

Thomas

[11] Patent Number: 4,729,478

[45] Date of Patent: Mar. 8, 1988

[54] BELLOWS SHOCK ABSORBING CONTAINER

[76] Inventor: William A. Thomas, 7405 Woodley Ave., Van Nuys, Calif. 91406

[21] Appl. No.: 47,787

[22] Filed: May 8, 1987

[51] Int. Cl.[4] ..... B65D 51/26

[52] U.S. Cl. ..... 206/591; 206/521

[58] Field of Search ..... 206/521, 583, 591

[56] References Cited

U.S. PATENT DOCUMENTS

| | | | |
|---|---|---|---|
| 4,019,637 | 4/1977 | Kurtz | 206/583 X |
| 4,055,670 | 10/1977 | Belmont | 206/521 X |
| 4,114,761 | 9/1978 | Kleiner | 206/591 |
| 4,215,786 | 8/1980 | Vertes | 206/591 X |

*Primary Examiner*—William Price

*Attorney, Agent, or Firm*—Poms, Smith, Lande & Rose

[57] ABSTRACT

A bellows-type shock absorbing container includes a lower main base member, and an upper closure, which may be mounted to the main base member by engaging threads, or by using a hinge and latch closure. The base member is provided with an inwardly directed rib or shoulder having an upper surface upon which the mounting flange of a waste pump or other delicate equipment to be transported, is mounted. The top closure is provided with a downwardly directed cylindrical extension, which bears on the upper surface of the flange of the equipment to be transported to hold it firmly in place. Both the top cover member and the base include reentrant bellows-type structures which provide resiliency and resistance to shock. In addition, the molded top and bottom, after they are threaded together, completely seal the unit to enclose all possible fluids or odors from the equipment being transported. The container is preferably made of molded plastic having some inherent flexibility, to provide the resilience needed in the shock absorbing bellows arrangements.

20 Claims, 3 Drawing Figures

BELLOWS SHOCK ABSORBING CONTAINER

FIELD OF THE INVENTION

This invention relates to containers for transporting delicate equipment which may also have fluids associated therewith.

BACKGROUND OF THE INVENTION

Certain types of equipment, such as electromechanical equipment, or any other pieces of equipment that could be damaged by severe shock, should be carefully packaged; for example, such equipment may need regular servicing, and must be transported with care to a location where such servicing may be accomplished. One example of this type of equipment is the waste pumps which are employed in flushing toilets mounted in aircraft. These waste pumps include a metal screen, bearings, a motor, and a grinder, which could be damaged by rough handling. Up to the present time, the available containers for transporting waste pumps or similar breakable equipment have not been entirely satisfactory.

Accordingly, a principal object of the present invention is to provide a container for transporting breakable equipment which may have fluids associated therewith, in a manner which will both seal the equipment and also protect it against damage, shock, and contamination, as it is being transported.

SUMMARY OF THE INVENTION

In accordance with a specific embodiment illustrating the principles of the present invention, a shock absorbing container for flange mounted breakable or delicate equipment, such as waste pumps or the like, includes a lower main container or base member and a top closure, so that the top closure may be threaded onto the main base member to seal the entire container. The lower base member includes an inwardly-directed shoulder or shelf upon which the flange of the waste pump or other equipment may rest, and the top includes a downwardly-extending, generally cylindrical extension portion which firmly seats against the top of the flange of the waste pump or other equipment to hold it securely in place, as the threads are tightened down.

The inwardly directed shoulder or shelf molded into the lower or base member is in the form of a bellows or resilient rib or ribs which flex when the lower part of the unit is subject to impact, for example if the unit is dropped on its base, thereby protecting the flange-mounted equipment from damage. Similarly, the lid or top closure for the container has a re-entrant structure or bellows included in its configuration whereby shock applied to the top of the assembled container is readily absorbed, and thereby protects the equipment being transported. More specifically, with regard to the configuration of the top, it may be considered to be formed of a continuous web extending from the inner cylindrical portion which engages the top of the flange of the waste pump or other equipment being transported, and extending upwardly to a circular line at approximately the height of the threads on the main container, then outwardly to the mating threads on the top closure and from the bottom of the threads on the top closure outwardly and upwardly to the top cap which completes the construction of the top closure portion of the assembly. This re-entrant upper closure structure has built-in resiliency so that downward pressure is exerted on the flange of the waste pump or other equipment when the threads are tightened, and the springiness of the material maintains the downward force on the mounting flange of the equipment, to hold the equipment firmly in place during transport.

The periphery of the upper closure member may extend outwardly beyond the surface of the base member, so that any shock which may be received on the top of the container is absorbed on the re-entrant bellows configuration of the top closure, rather than being applied to the upper portion of the base member carrying the flange on which the equipment is mounted.

In accordance with a broader aspect of the invention, a shock absorbing container may include a lower base member having upper and lower portions separated by a flexible inwardly-directed rib or bellows, and arrangements for mounting the equipment to be transported on the upper portion of the base member above the resilient rib or bellows. In addition, the container may include an upper closure member which also includes a resilient or protective bellows or re-entrant configuration to protect the upper portion of the base member from shocks which may be applied to the top closure member.

Another feature of the invention involves the construction of both parts of the container of molded plastic having moderate resiliency, and with both the two parts being threaded firmly together to preclude the excape of fluids or odors.

Other objects, features, and advantages of the invention will become apparent from a consideration of the following detailed description and from the accompanying drawings.

DETAILED DESCRIPTION

Figure 1:
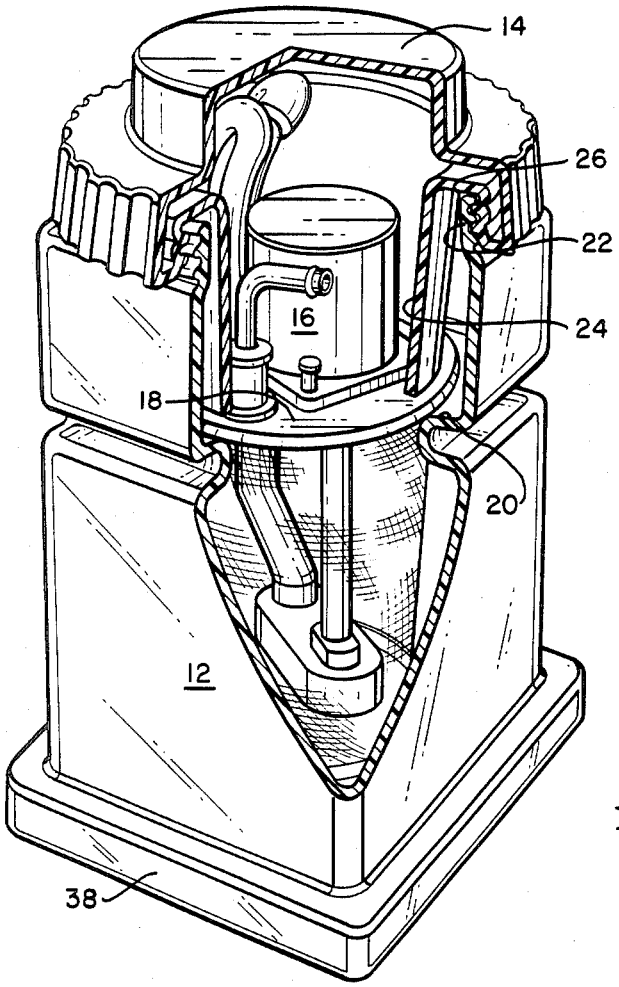
FIG. 1 is a cut-away perspective view of a bellows-type shock absorbing container, illustrating the principles of the present invention, with a waste pump mounted therein.

Referring more particularly to the drawings, FIG. 1 is a cut-away view of a container including a base member 12, and an upper closure 14 for transporting a waste pump 16 shown with its intermediate flange 18 mounted on the inwardly directed rib or shoulder 20 of the base member 12. The base member 12 and the top closure 14 have mating threads 22 by which the top closure 14 is secured to the base member 12. The top closure member 14 has an inner downwardly directed cylindrical portion 24 which engages the top of the flange 18 of the waste pump 16 and holds it firmly against the shoulder 20, thereby locking the waste pump in position. Incidentally, the base 12 and the top closure member 14 are both made of relatively resilient material, so that the inwardly directed web 26 applies resilient downward pressure to the cylindrical member 24, when the top closure 14 is threaded firmly down onto the base member at the mutually engaging threads 22.

Figure 2:
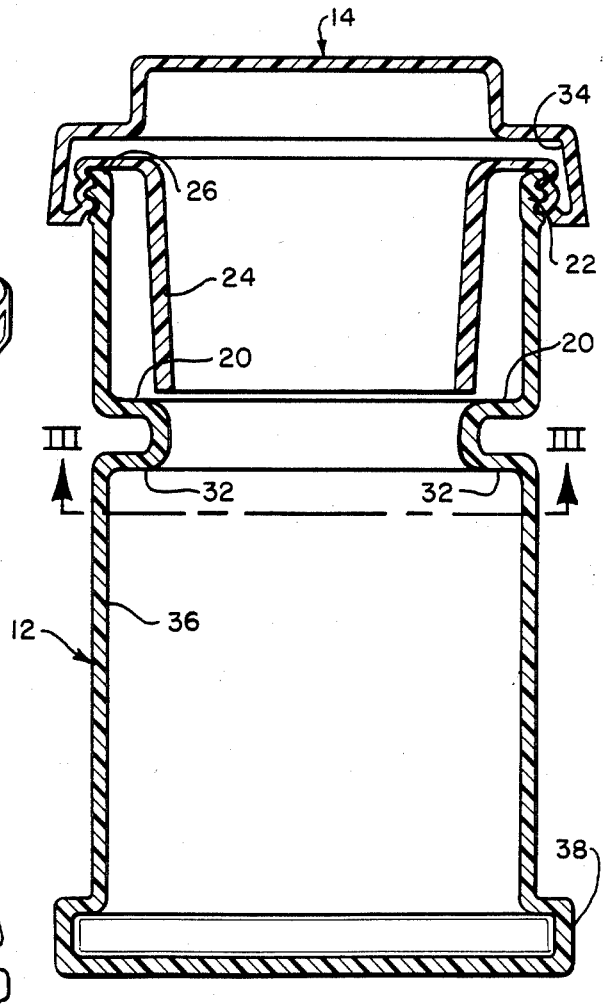
FIG. 2 is a cross-sectional view through the container of FIG. 1.

Referring now to FIG. 2, the reference numerals from FIG. 1 have been carried over to this second figure of the drawings. FIG. 2 is a cross-sectional view taken through the center of the container, and shows the top closure member 14 secured to the lower base member 12 at the threads 22. When the closure 14 is screwed all the way down, the substantially cylindrical member 24 is within about ⅛ of an inch of the upper surface of the inwardly directed rib or shoulder 20, upon which the flange of the waste pump would rest, when it is mounted for transport.

It may be noted that the lower portion 32 of the inwardly directed rib provides considerable resiliency in the mounting of the waste pump within the unit, with the flange of the waste pump engaging the upper surface 20 of the inwardly directed rib. Thus, with the unit being formed of polypropylene in the order of ⅛ inch thick, when you apply force of about 40 or 50 pounds to the edge of the cover, immediately over one corner of the base, the two sides of the rib or shoulder 20, 32, are brought to a point where they almost engage one another, from a normal unstressed separation of about ¾ inch.

Attention is also directed to the re-entrant or bellows structure 34 included in the top closure 14 extending from the bottom of the mating threads 22, up to the top of member 14. This configuration provides considerable resiliency and protection in the event that a shock should be applied to the container 12 from the top.

Figure 3:
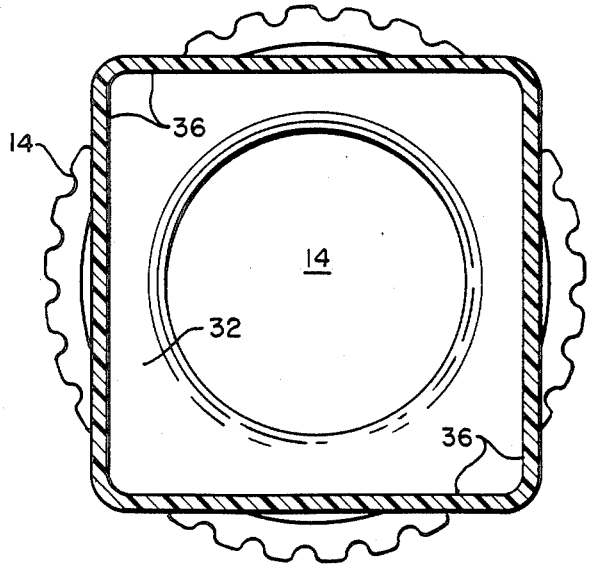
FIG. 3 is a cross-sectional view taken along lines III—III of FIG. 2.

FIG. 3 is a cross-sectional view taken along lines III—III of FIG. 2. The square cross-sectional configuration 36 is the vertical wall of the base member extending upwardly from the larger pedestal 38 (see FIGS. 1 and 2) to the rib or shoulder 32, 20. The top closure member 14 may be seen in FIG. 3 both through the central opening defined by the rib or shoulder 20, 32, and around the outer periphery of the sidewalls 36 of the base member.

Incidentally, both the base member and the top closure may be molded of polyethylene of a form having moderate stiffness, but reasonable flexibility, as discussed hereinabove. If desired, a higher strength cross-linked plastic material may be employed. It may be noted that the present structure is particularly suitable for the transport of the waste pumps of the type employed in airplane toilets or the like, in view of the fact that any fluid or residual waste material which may be adhering to the waste pump will be fully enclosed within the container, and any possible dripping fluids or unpleasant odors will be tightly sealed within the container by the tightly fitting threads 22.

For completeness, it is noted that both parts of the container are formed by a known process referred to as rotational molding. In this process pellets of plastic are placed within a closed mold, the mold is heated and rotated so that the plastic coats the walls of the mold, and then the mold is cooled, and the part removed. Concerning the dimensions of the specific container illustrated in the drawings, the walls vary slightly in thickness, but are about ⅛ inch thick. The pedestal or bottom of the base is about 10 inches by 10½ inches, with a slight taper toward the center of one side to facilitate removal from the mold. The vertically extending wall, referenced in cross-section by reference numeral 36 in FIG. 3, is about 8½ inches by 8½ inches. The outer diameter of the threads on the base member is approximately 9 inches, and the height of the base member is about 16¼ inches. Concerning the top cover, it has an overall vertical extent of about 6¾ inches, and an outer diameter of approximately 10 inches. The top cap portion has a lesser diameter of about 7 inches and extends upwardly about 1½ inches above the outwardly extending bellows 34 as shown in FIG. 2. The upper surface of the inwardly directed rib or shoulder 20,32 is approximately 11¼ inches above the bottom of the unit, and its inner diameter is about 6¼ inches.

It is to be understood that the foregoing description and the accompanying drawings relate to one preferred and illustrative embodiment of the invention. Various modified constructions may be employed without departing from the spirit and scope of the invention. Thus, by way of example and not of limitation, instead of using only one rib or shoulder 20, 32, a plurality of such ribs may be employed to provide additional flexibility or resiliency. In addition, the equipment to be transported may be secured to the upper portion of the base member 12 in a manner other than by its flange. Thus, for example, inwardly protruding studs having mounting holes therein may be provided in the upper portion of the base member 12, to match the normal mounting arrangements for the equipment under consideration, and the equipment may be secured in place by bolts or mounting screws. Also, instead of having a square or rectangular base configuration, the base may be circular, hexagonal, or have any other desired external configuration. Further, instead of being threaded, the top closure may be hinged to the base member with a tongue and groove seal, and a latch closure. Accordingly, the present invention is not limited to that precisely as shown and described.

What is claimed is:

1. A bellows-type shock absorbing container assembly for flange mounted breakable equipment having fluids associated therewith, the container comprising:

a lower or base portion of the container formed of resilient plastic, open at the top and having an inwardly directed rib or shoulder forming an opening with a peripheral shelf for mounting the flange of the equipment to be packaged, said lower or base portion of the container extending upwardly to a threaded upwardly extending open end;

an upper closure portion of the container including circular threaded plastic material having threads which mate with the threads on the upper end of said lower portion of the container;

said upper portion of the container including downwardly extending, generally cylindrical holding means for engaging the upper side of the flange of the equipment to be packaged; and said upper portion including a continuous web of material extending outwardly and then upwardly from said threads to form a resilient bellows member, and said web of material extending inward to complete a sealing cap for the entire container assembly;

whereby the recess below the peripheral shelf forms a resilient bellows which protects the packaged equipment from shocks received on the base of the container assembly, and the outwardly and upwardly extending bellows configuration of the upper portion of the container provides a second resilient bellows which protects the equipment from shock applied to the upper portion of the container assembly.

2. A bellows-type shock absorbing container assembly as defined in claim 1 wherein said upper closure portion of said container has an outer diameter which extends outward substantially beyond the side walls of the base portion of the container.

3. A bellows-type shock absorbing container assembly as defined in claim 1 wherein said base portion of said container has a pedestal or lower rim which extends outwardly beyond the side walls of the container.

4. A bellows-type shock absorbing container assembly as defined in claim 1 wherein said container is formed of rotationally molded plastic.

5. A bellows-type shock absorbing container assembly as defined in claim 1 wherein said container is substantially fluid tight and sealed against release of odors when said two portions of said container are threaded together.

6. A bellows-type shock absorbing container assembly as defined in claim 1 wherein said assembly includes means for concurrently sealing said container and for resiliently clamping the equipment being packaged firmly within the container when said closure portion is tightly threaded onto said base portion of said assembly.

7. A bellows-type shock absorbing container assembly as defined in claim 1 wherein said opening is substantially circular.

8. A bellows-type shock absorbing container assembly as defined in claim 1 wherein said base portion of said container is substantially rectangular in cross-sectional configuration.

9. A bellows-type shock absorbing container assembly for breakable equipment having fluids associated therewith, the container comprising:

a base portion of the container formed of resilient plastic, open at the top and having an inwardly directed rib or shoulder forming a bellows-type resilient coupling between the lower section of the base portion and an upper section thereof, said base portion of the container extending upwardly to a threaded upwardly extending open end;

means for mounting the equipment to be packaged on said upper section of the base portion of said container;

a closure portion of the container including circular threaded plastic material having threads which mate with the threads on the upper end of said base portion of the container;

said closure portion of the container including downwardly extending means for engaging the equipment to be packaged; and said upper portion including a continuous web of material extending outwardly and then upwardly from said threads to form a resilient bellows member, and said web of material extending inward to complete a sealing cap for the entire container assembly;

whereby said rib or shoulder forms a resilient bellows which protects the packaged equipment from shocks received on the base of the container assembly, and the outwardly and upwardly extending bellows configuration of the closure portion of the container provides a second resilient bellows which protect the equipment from shock applied to the closure portion of the container assembly.

10. A bellows-type shock absorbing container assembly as defined in claim 9 wherein said upper closure portion of said container has an outer diameter which extends outward substantially beyond the side walls of the base portion of the container.

11. A bellows-type shock absorbing container assembly as defined in claim 9 wherein said base portion of said container has a pedestal or lower rim which extends outwardly beyond the side walls of the container.

12. A bellows-type shock absorbing container assembly as defined in claim 9 wherein said container is formed of rotationally molded plastic.

13. A bellows-type shock absorbing container assembly as defined in claim 9 wherein said container is substantially fluid tight and sealed against release of odors when said two portions of said container are threaded together.

14. A bellows-type shock absorbing container assembly as defined in claim 9 wherein said assembly includes means for concurrently sealing said container and for resiliently clamping the equipment being packaged firmly within the container when said closure portion is tightly threaded onto said base portion of said assembly.

15. A bellows-type shock absorbing container assembly for breakable equipment having fluids associated therewith, the container comprising:

a base portion of the container formed of resilient plastic open at the top and having an inwardly directed rib or shoulder forming a bellows-type resilient coupling between the lower section of the base portion and an upper section thereof, said base portion of the container extending upwardly to a threaded upwardly extending open end;

means for mounting the equipment to be packaged on said upper section of the base portion of said container;

a closure portion of the container including circular threaded plastic material having threads which mate with the threads on the upper end of said base portion of the container;

said closure portion forming sealing cap for the entire container assembly, and including resilient bellows means between the threads and the uppermost portion of said closure portion;

whereby said rib or shoulder forms a resilient bellows which protects the packaged equipment from shocks received on the base of the container assembly, and the bellows configuration of the closure portion of the container provides a second resilient bellows which protects the equipment from shock applied to the closure portion of the container assembly.

16. A bellows-type shock absorbing container assembly as defined in claim 15 wherein said upper closure portion of said container has an outer diameter which extends outward substantially beyond the side walls of the base portion of the container.

17. A bellows-type shock absorbing container assembly as defined in claim 15 wherein said base portion of said container has a pedestal or lower rim which extends outwardly beyond the side walls of the container.

18. A bellows-type shock absorbing container assembly as defined in claim 15 wherein said container is formed of rotationally molded plastic.

19. A bellows-type shock absorbing container assembly as defined in claim 15 wherein said container is substantially fluid tight and sealed against release of odors when said two portions of said container are threaded together.

20. A bellows-type shock absorbing container assembly as defined in claim 15 wherein said assembly includes means for concurrently sealing said container and for resiliently clamping the equipment being packaged firmly within the container when said closure portion is tightly threaded onto said base portion of said assembly.

* * * * *